US006755305B2

(12) United States Patent
Nance

(10) Patent No.: US 6,755,305 B2
(45) Date of Patent: Jun. 29, 2004

(54) CONDIMENT CUP

(76) Inventor: Gary Nance, 1805 Ellison Dr., Modesto, CA (US) 95355

( * ) Notice: Subject to any disclaimer, the term of this patent is extended or adjusted under 35 U.S.C. 154(b) by 84 days.

(21) Appl. No.: 10/253,784

(22) Filed: Sep. 24, 2002

(65) Prior Publication Data

US 2003/0019871 A1 Jan. 30, 2003

Related U.S. Application Data

(63) Continuation-in-part of application No. 09/896,714, filed on Jun. 30, 2001, now abandoned, which is a continuation-in-part of application No. 09/590,607, filed on Jun. 9, 2000, now Pat. No. 6,394,297.

(60) Provisional application No. 60/138,704, filed on Jun. 11, 1999.

(51) Int. Cl.[7] ..... B65D 25/28

(52) U.S. Cl. ..... 206/519; 206/518; 206/515

(58) Field of Search ..... 206/515, 518, 206/519

(56) References Cited

U.S. PATENT DOCUMENTS

| | | | | |
|---|---|---|---|---|
| 1,990,026 A | | 2/1935 | Glen, Jr. | |
| 2,161,577 A | | 6/1939 | Howlett | |
| 2,597,468 A | | 5/1952 | Garrett | |
| 3,442,435 A | | 5/1969 | Ludder et al. | |
| 3,841,528 A | * | 10/1974 | Eisenberg | 222/143 |
| 4,049,187 A | * | 9/1977 | Florian | 229/402 |
| 4,094,431 A | | 6/1978 | Wheeler | |
| 4,183,444 A | | 1/1980 | English et al. | |
| 4,811,860 A | * | 3/1989 | Sorenson et al. | 220/380 |
| 4,848,580 A | | 7/1989 | Wise | |
| 4,854,466 A | | 8/1989 | Lane, Jr. | |
| 5,092,480 A | | 3/1992 | Waterston | |
| 5,108,000 A | | 4/1992 | Stoll et al. | |
| 5,219,419 A | * | 6/1993 | Prothe | 206/515 |
| 5,417,338 A | | 5/1995 | Roy et al. | |
| 5,439,262 A | | 8/1995 | Sharkey | |
| 5,590,804 A | | 1/1997 | Crum et al. | |
| 6,152,362 A | | 11/2000 | Rosenfeld | |

OTHER PUBLICATIONS

Photocopy of McDonald's sauce container, an injection molded cup for holding a condiment and having a seal Photocopy made May 25, 2001.

* cited by examiner

*Primary Examiner*—Joseph Man-Fu Moy
(74) *Attorney, Agent, or Firm*—Eric Karich

(57) ABSTRACT

A condiment container has a base and an upwardly extending sidewall that together define a storage space. The upwardly extending sidewall terminates in a perimeter lip that defines an opening for accessing the storage space. The condiment container also includes an attachment arm extending downwardly from the perimeter lip to a terminal end. A nesting aperture is positioned behind the attachment arm to enable nesting.

17 Claims, 9 Drawing Sheets

Fig. 19
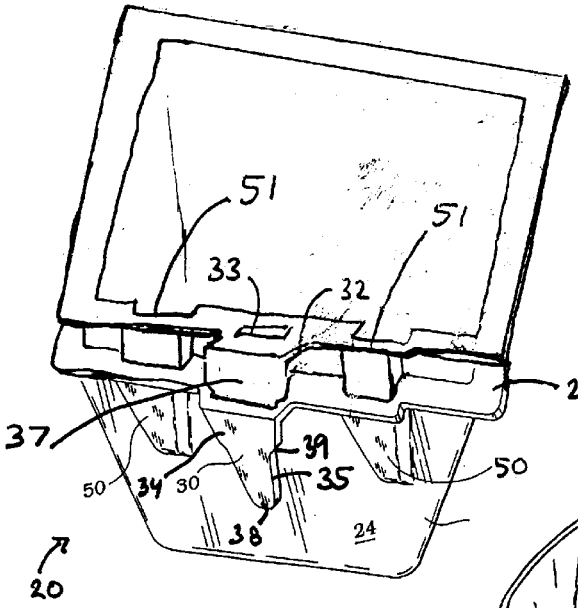
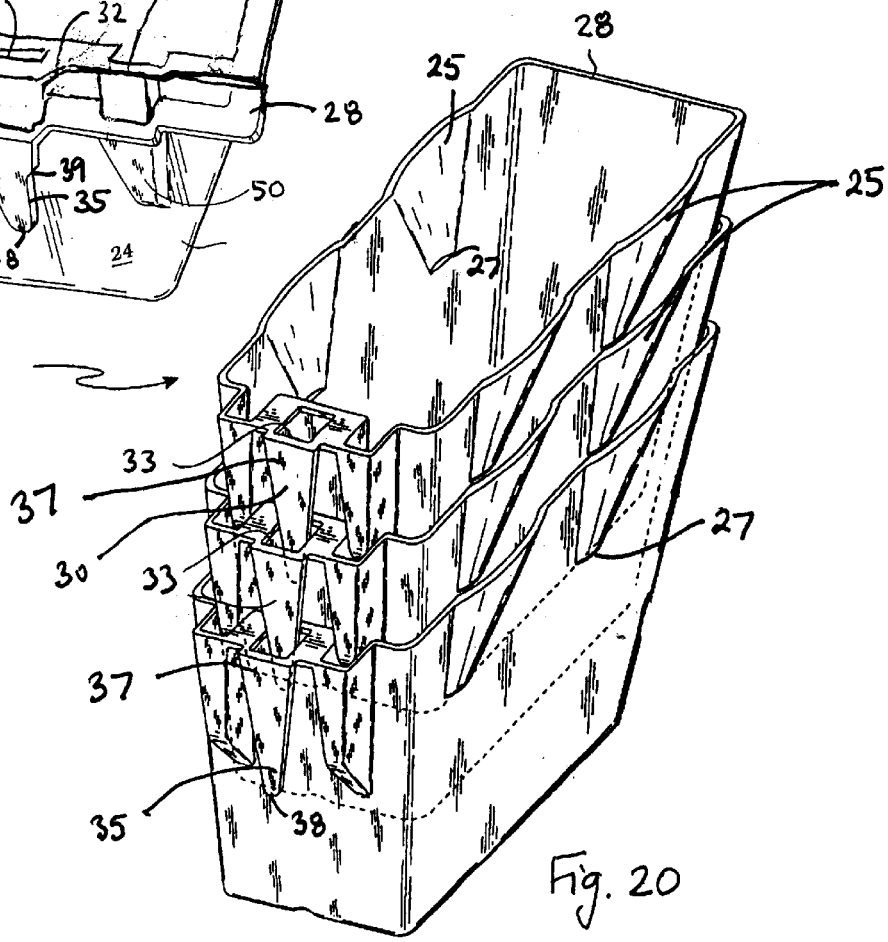
Fig. 20

CONDIMENT CUP

CROSS-REFERENCE TO RELATED APPLICATIONS

This application for a utility patent is a continuation-in-part of patent application Ser. No. 09/896,714, filed Jun. 30, 2001 now abandoned, and patent application Ser. No. 09/590,607, filed Jun. 9, 2000, now issued as U.S. Pat. No. 6,394,297 B1. This application for a utility patent claims the benefit of U.S. Provisional Application No. 60/138,704, filed Jun. 11, 1999.

STATEMENT REGARDING FEDERALLY SPONSORED RESEARCH

Not Applicable

BACKGROUND OF THE INVENTION

1. Field of the Invention

This invention relates generally to condiment cups, and more particularly to a condiment cup that is adapted to be removably fastened to a food storage container.

2. Description of Related Art

There is a need in the marketplace for a secondary container that can be readily attached to a food storage container. An example of a market for such a product is in the fast food industry. In the sale of fast food, it is desirable to be able to dispense condiments such as ketchup in a condiment cup that can be readily carried with a food storage container containing an associated foods, such as frenchfries. The following references represent the state of the art in this field:

Sharkey, U.S. Pat. No. 5,429,262, teaches a condiment container that includes a pair of prongs for easy attachment to an associated foodstuff container. A lid is provided to snap over a flange of the container for covering an opening of the container.

Ludder et al., U.S. Pat. No. 3,442,435, teaches a package for dispensing comestibles. The package includes a well for containing a condiment such as ketchup. The well includes a lip that is adapted to hang the condiment on the package that contains the comestibles. The well is adapted to allow nesting during storage.

Garrett, U.S. Pat. No. 2,597,468, teaches a supplementary container for holding cream on the rim of a coffee cup. The supplementary container includes a hook-shaped member for mounting the container on the coffee cup, and a positioning rib that is positioned beneath the hook-shaped member for clamping the coffee cup.

Waterston et al., U.S. Pat. No. 5,097,975, teaches a recyclable materials caddy that can be attached to a waste receptacle. The caddy is constructed of a linear blank of corrugated plastic and includes a metal hangar member that allows the caddy to be mounted on the rim of a wastebasket.

It is desirable that the condiment cup be securely attachable to the storage container so as to prevent spillage. To meet this goal, the container must have an attachment arm or arms for attaching the condiment cup to the storage container. It is also desirable that the condiment cup include a grip enhancer for increasing the stability of the attachment. Yet this type of structure is typically expensive to manufacture, ship, and store.

It is a goal of the present invention to provide a condiment cup that can be securely attached to a container while still being inexpensive to manufacture, store, and ship. The prior art does not teach a condiment cup that includes an attachment arm for removably attaching the condiment cup to the storage container, while still enabling two or more of the condiment cups to nest within each other. The present invention fulfills these needs and provides further related advantages as described in the following summary.

SUMMARY OF THE INVENTION

The present invention teaches certain benefits in construction and use which give rise to the objectives described below.

The present invention provides a condiment container for containing a condiment and for attachment to a storage container. The condiment container has a base and an upwardly extending sidewall that together define a storage space, the upwardly extending sidewall terminating in a perimeter lip that defines an opening for accessing the storage space. The condiment container also includes an attachment arm extending downwardly from the perimeter lip to a terminal end. A nesting aperture is positioned behind the attachment arm to enable nesting.

A primary objective of the present invention is to provide a condiment cup having advantages not taught by the prior art.

Another objective is to provide a condiment cup having an attachment art, the condiment cup being constructed so that it can nest within another of the condiment cups.

A further objective is to provide a condiment cup that can nest within another of the condiment cups without nesting so far that it is difficult to remove.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings:

FIG. 19 is a perspective view of two of the condiment cups illustrating how one of the condiment cups will nest within the other; and FIG. 20 is a perspective view of two of an alternative embodiment of the condiment cups illustrating how one of the condiment cups will nest within the other.

DETAILED DESCRIPTION OF THE INVENTION

Figure 1:
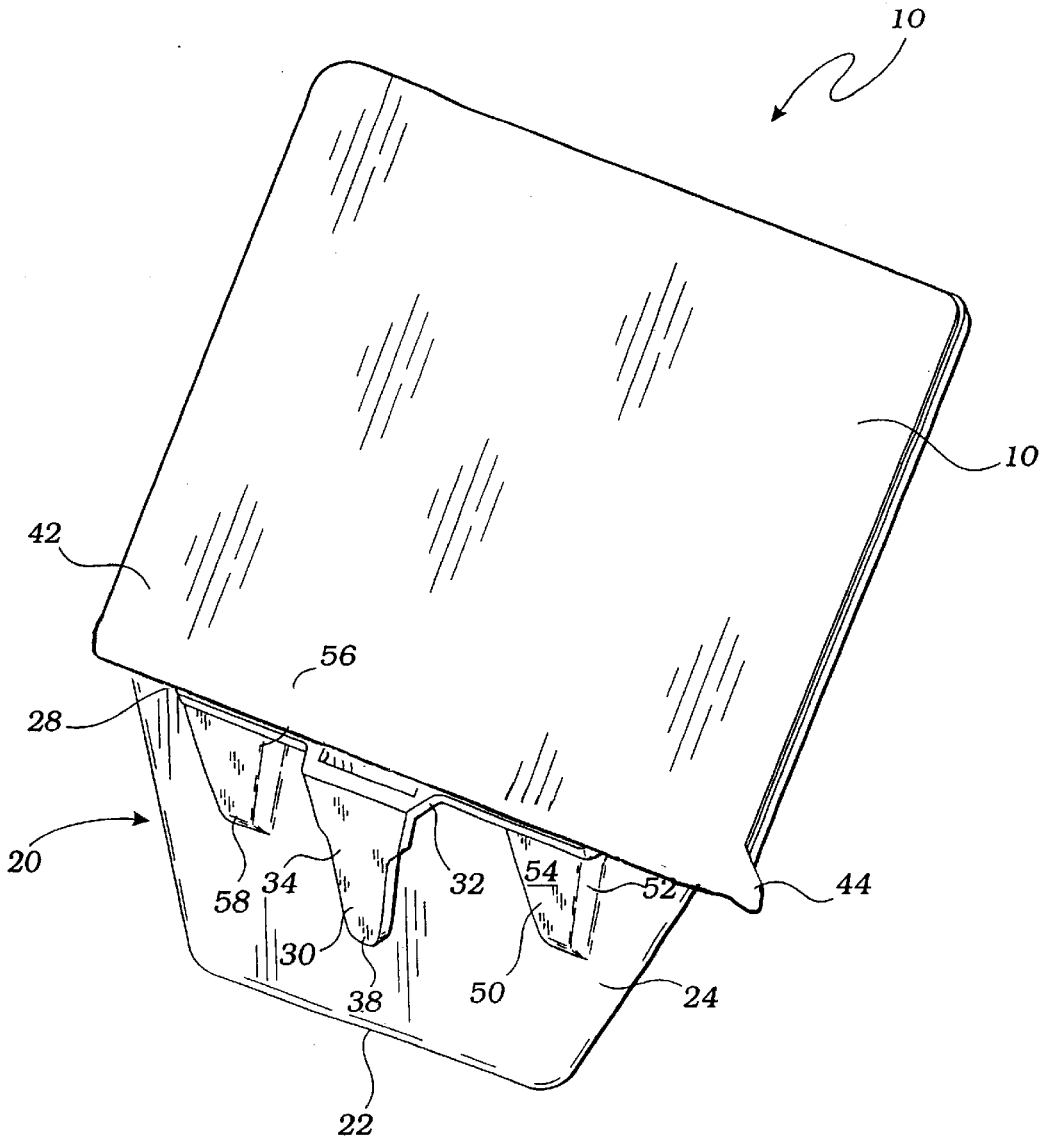
FIG. 1 is a perspective view of the preferred embodiment of the present invention.
Figure 2:
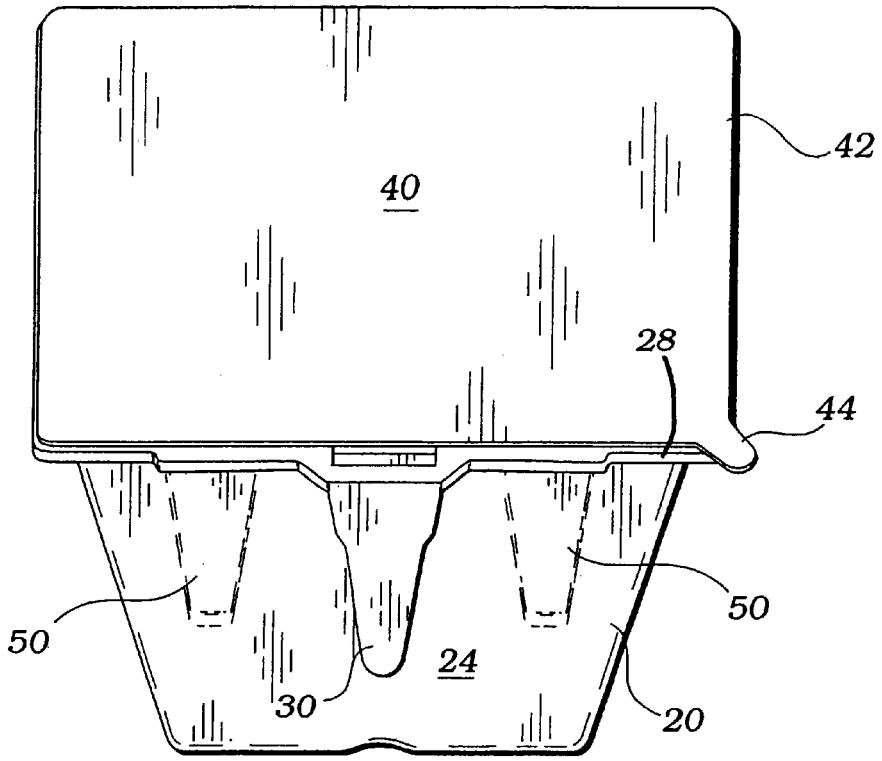
FIG. 2 is a front elevational view thereof.

The above described drawing figures illustrate the invention, a condiment cup 10 for containing a condiment 16 and for attachment to a storage container sidewall 14 of a storage container 12. As is generally shown in FIGS. 1–8, the condiment cup 10 includes a condiment container 20 for storing the condiment 16, an attachment arm 30 for attaching the condiment container 20 to the storage container 12, and a sealing lid 40 for sealing the condiment container 20. The condiment container 20 is typically filled with the condiment 16, such as ketchup, sealed with a sealing lid 40, and then distributed to patrons of fast food restaurants. The patrons then peel off the sealing lid 40 and hang the condiment container 20 on the storage container 12, such as a container of French fries.

As shown in FIGS. 1–8, the condiment container 20 has a base 22 and an upwardly extending sidewall 24 that together define a storage space 26. The upwardly extending sidewall 24 terminates in a perimeter lip 28 that defines an opening 29 for accessing the storage space 26. The perimeter lip 28 extends outwardly for bonding the sealing lid 40 onto the condiment container 20, as described below. The opening 29 is shaped and sized to enable the patron to easily access the condiment 16 in the condiment container 20, typically by dipping a food product such as French fries into the condiment 16 such as ketchup. The condiment container 20 is preferably constructed of molded plastic, although alternative embodiments might be constructed of paperboard or similar material.

Figure 16:
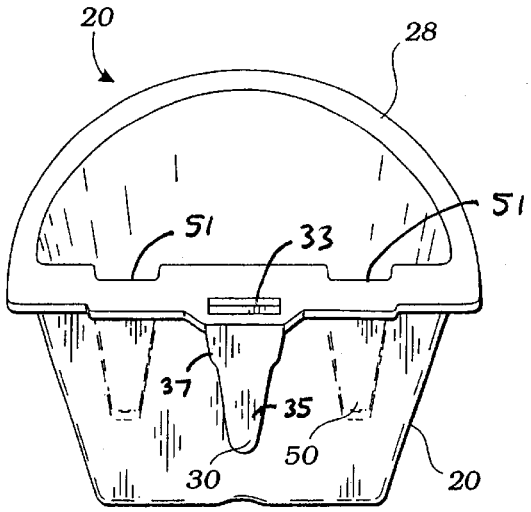
FIG. 16 is a perspective view of an alternative embodiment illustrating a condiment cup having a perimeter lip in the shape of a half-circle.
Figure 17:
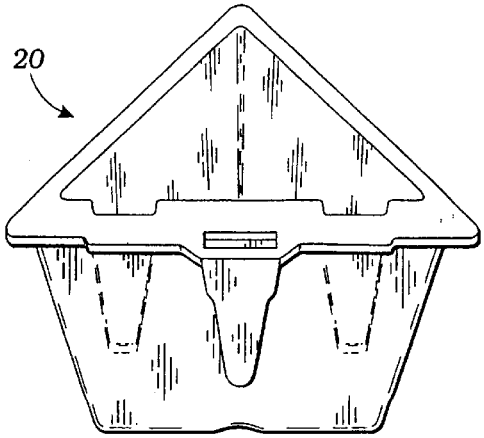
FIG. 17 is a perspective view of an alternative embodiment illustrating a condiment cup having a perimeter lip in the shape of a triangle.
Figure 18:
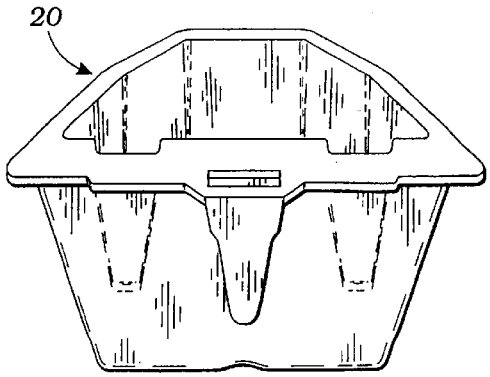
FIG. 18 is a perspective view of an alternative embodiment illustrating a condiment cup having a perimeter lip in the shape of a half-trapezoid.

The condiment container 20 is preferably generally rectangular in shape; however, as shown in FIGS. 16–18, the condiment container 20 can be constructed of almost any shape, including but not limited to a half-circle, triangular, half-hexagonal, or any other shape, including round or elliptical. The condiment container 20 can also be conical in shape, as the base 22 does not necessarily have to be formed as a flat surface.

As shown in FIGS. 1, 4, 19, and 20, the condiment cup 10 further includes an attachment arm 30 extending downwardly from the perimeter lip 28. The attachment arm 30 preferably includes an outwardly extending portion 32, a downwardly extending portion 34, and ends at a terminal end 38. The outwardly extending portion 32 and the downwardly extending portion 34 are at least semi-rigid to support the condiment cup 20 as described. The outwardly extending portion 32 functions to outwardly space the downwardly extending portion 34 from the upwardly extending sidewall 24. The attachment arm 30 is preferably integrally molded with the condiment container 20 and extends far enough downward to provide a secure anchor point for the condiment cup 10, but not so far as to interfere with shipping and handling of the condiment cup 10. The attachment arm 30 preferably extends approximately half of the height of the upwardly extending sidewall 24.

As shown in FIG. 19, the outwardly extending portion 32 of the attachment arm 30 preferably includes a nesting aperture 33, behind the attachment arm 30, that is shaped to receive at least a portion of the downwardly extending portion 34. In the preferred embodiment, the downwardly extending portion 34 includes an upper portion 37 and a nesting portion 35. The upper portion 37 has a width that is greater than the width of the nesting aperture 33, and the nesting portion 35 has a width that is less than the width of the nesting aperture 33. In the most preferred embodiment, the upper portion 37 and the nesting portion 35 are separated by a nesting shoulder 39 that is shaped to prevent the upper portion 37 from becoming wedged within the nesting aperture 33.

The narrow width of the nesting portion 30 enables it to slide into the nesting aperture 33 to enable nesting of the condiment containers 20; however, since the upper portion 37 is too wide to slide into the nesting aperture 33, the depth of the nesting is thereby restricted. It is preferred that the depth of the nesting be restricted because this prevents two of the condiment containers 20 from becoming stuck together and interfering with the use of the condiment container 20, either by a consumer or when the condiment containers 20 are filled and sealed.

FIG. 20 illustrates another embodiment of the invention, wherein the downwardly extending portion 34 is tapered. In this embodiment, the downwardly extending portion 34 is tapered and does not include the nesting shoulder 39. The downwardly extending portion 34 still includes the upper portion 37 and the nesting portion 35; however, these elements are separated by an imaginary line where the downwardly extending portion 34 becomes too large to fit into the nesting aperture 33.

As shown in FIG. 20, in some embodiments the upwardly extending sidewall 24 includes at least one shaped portion 25 that is shaped to prevent the condiment containers 20 from over-nesting, that is, nesting too deeply and becoming stuck, as described above. In the preferred embodiment, the at least one shaped portion 25 includes a plurality of generally curved sections that each preferably include a flat base portion 27. Each of the plurality of generally curved sections 25 nest within a corresponding section in another condiment container 20 and prevent over-nesting. The flat base portion 27 provides additional protection against over-nesting, particularly in situations where a stack of the condiment containers 20 are compressed together. While the particular shape shown in currently preferred, those skilled in the art can devise an infinite number of shapes, lips, ledges, and protrusions that function as described herein, and all of these different shapes should be considered within the scope of the term "shaped portion" 25.

Once the condiment container 20 has been formed, it is typically stored in nested stacks to lower storage, shipping, and handling costs. The condiment containers 20 can then be shipped directly to the consumer for use. In this embodiment, the condiment containers 20 are distributed in a restaurant that maintains the condiment 16 in bulk so that it can be dispensed into one of the condiment containers 20 for consumption.

In the alternative, the condiment container 20 can be shipped to another facility to be filled with a condiment 16. It is helpful, in the filling process, for the condiment container 20 to be stored in nested stacks because this facilitates the automated filling process. Once the condiment container 20 has been filled with the condiment 16, the sealing lid 40 is attached to the condiment container 20.

Figure 7:
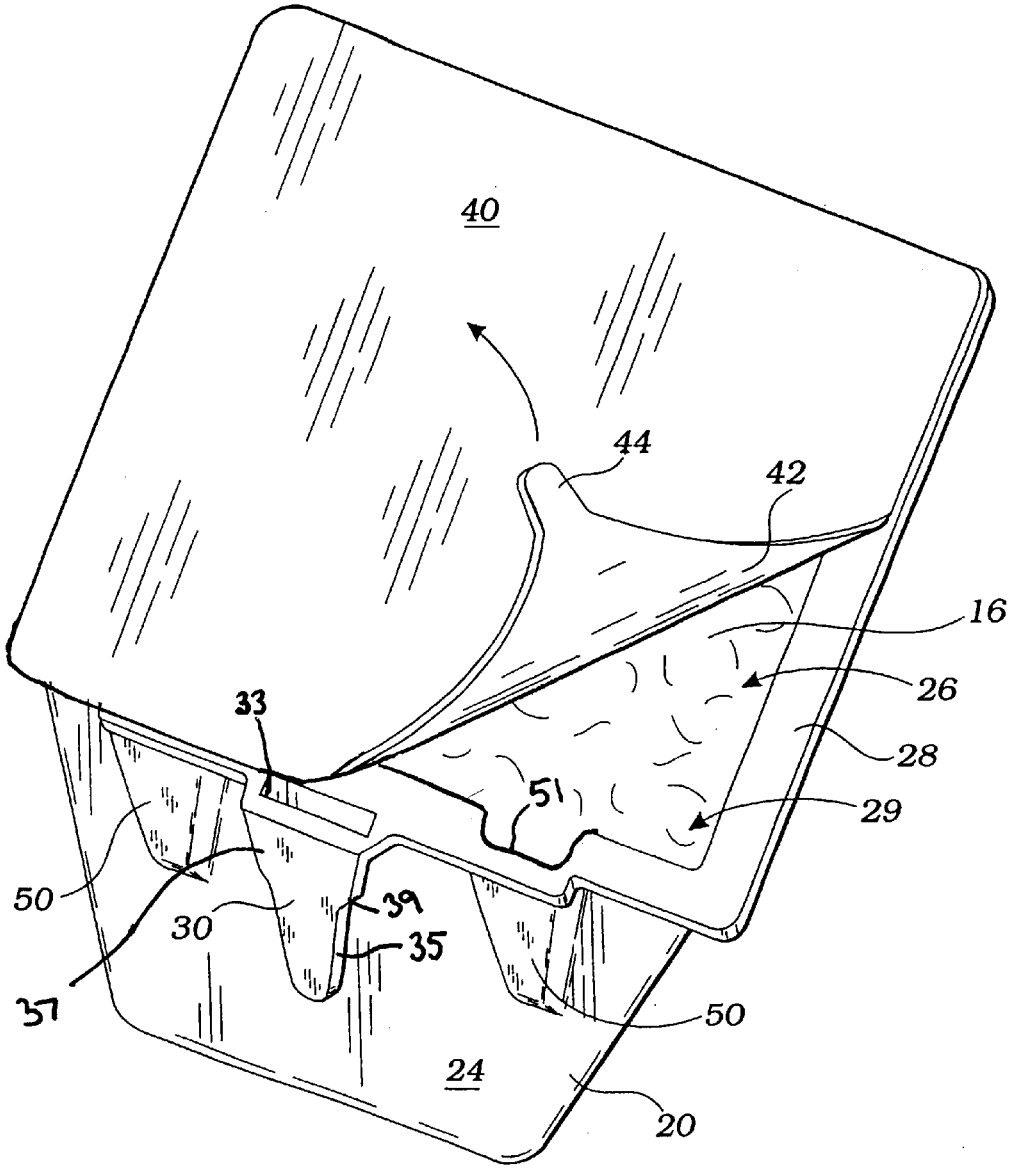
FIG. 7 is a perspective view illustrating how a sealing lid is peeled off of a condiment container.

As shown in FIGS. 1 and 7, the sealing lid 40 has a lid perimeter 42 that is shaped and adapted to be bonded to the perimeter lip 28 such that the sealing lid 40 seals the opening 29 of the condiment container 20. The sealing lid 40 preferably includes a pull tab 44 that extends outwardly from the lid perimeter 42 for facilitating the peel-removal of the sealing lid 40 from the condiment container 20. The sealing lid 40 is preferably constructed of a thin material such as foil or plastic. The lid perimeter 42 of the sealing lid 40 is preferably bonded to the perimeter lip 28, either with an adhesive or a heat welding, although those skilled in the art may devise other equivalent mechanisms for bonding the two surfaces, and these alternatives should be considered within the scope of the claimed invention.

Figure 8:
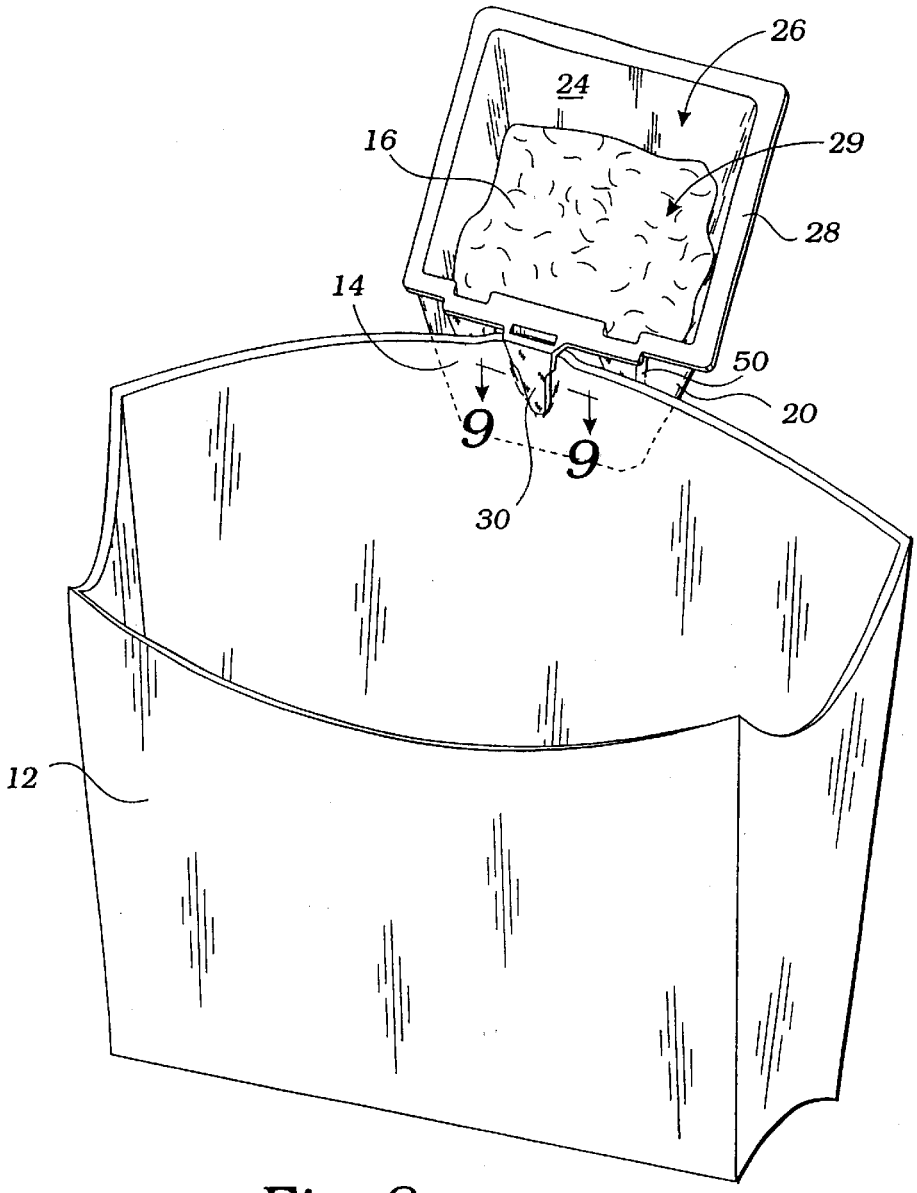
FIG. 8 is a perspective view illustrating how the condiment container is attached to a storage container with an attachment arm.

In use, the patron of a fast food restaurant is given the condiment cup 10, sealed, with their meal. As shown in FIG. 7, when the patron is ready to consume the meal, he or she simply peels the sealing lid 40 from the condiment container 20 to expose the condiment 16. For example, when the patron orders French fries, he or she is given a condiment cup 10 wherein the condiment 16 is ketchup. This of course will vary depending upon the restaurant. A Mexican restaurant might serve nachos, in which case the condiment cup 10 might be filled with salsa or cheese. A chicken restaurant might serve chicken with a condiment cup 10 full of barbeque sauce. Since the condiment cup 10 can hold a large amount of condiment 16, a single container is all that is required, rather than a large number of small packets of the condiment. The condiment cup 10 reduces waste of the condiment by including the condiment in a single container, rather than dispensing large numbers of small packets As shown in FIG. 8, the patron can then hang the condiment container 20 on the storage container sidewall 14 of the storage container 12. In this position it is convenient for the patron to dip his or her food through the opening 29 of the condiment container 20 and into the condiment 16. The condiment cup 10 provides a handy method of dispensing the condiment 16 while the patron eats his or her meal.

As shown in FIGS. 1, 2, 4, 6–10, the condiment cup 10 preferably includes at least one grip enhancer 50 extending outwardly from the upwardly extending sidewall 24 adjacent the attachment arm 30. The at least one grip enhancer 50 provides an outwardly extending sidewall 52 that supports a grip surface 54. The outwardly extending sidewall 52 is preferably integral with the upwardly extending sidewall 24 and extends outwardly from the upwardly extending sidewall 24 approximately the same distance as the outwardly extending portion 32 of the attachment arm 30. For purposes of this application, when we say that the outwardly extending sidewall 52 extends outwardly from the upwardly extending sidewall 24 approximately the same distance as the outwardly extending portion 32 of the attachment arm 30, this is intended to include the situation when the outwardly extending sidewall 52 extends outwardly from the upwardly extending sidewall 24 a distance that is slightly less than the outwardly extending portion 32 of the attachment arm 30—as long as the relationship between the outwardly extending sidewall 52 and the attachment arm 30 is functional to grip the storage container sidewall 14.

Figure 9:
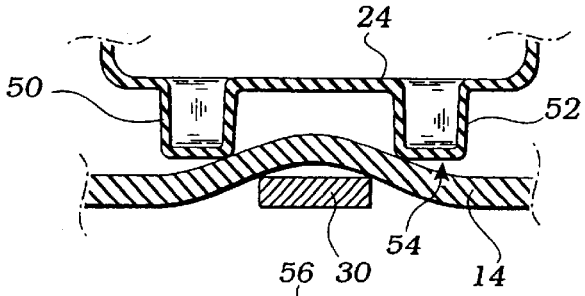
FIG. 9 is a is a sectional view thereof taken along line 9—9 in FIG. 8.

The grip surface 54 is preferably an elongate surface that is generally parallel to the attachment arm 30. The grip surface 54 is vertically aligned with and horizontally spaced from the attachment arm 30. For purposes of this application, vertically aligned means that at least a portion of the grip surface 54 is the same distance from the base 22 as at least a portion of the attachment arm 30; and specifically, that a top edge 56 of the grip surface 54 is higher than a terminal end 38 of the attachment arm 30. In the preferred embodiment, the grip surface 54 is positioned between the outwardly extending portion 32 of the attachment arm 30 and the terminal end 38. As shown in FIG. 9, the grip surface 54 is adapted to cooperate with the attachment arm 30 to clamp the storage container sidewall 14 and thereby support the condiment cup 10 on the storage container sidewall 14.

In a first embodiment, as shown in FIG. 1, the at least one grip enhancer 50 includes two grip enhancers 50, each of the two grip enhancers 50 being horizontally spaced on either side of the attachment arm 30. The grip surface 54 of the grip enhancers 50 are adapted to cooperate with the attachment arm 30 to clamp the storage container sidewall 14 and thereby support the condiment cup 10 on the storage container sidewall 14.

Figure 10:
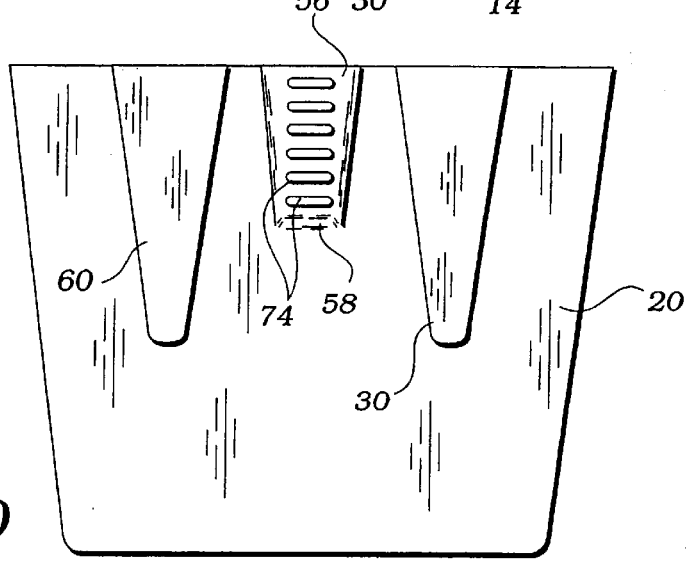
FIG. 10 is a front elevational view of an alternative embodiment having a second attachment arm adjacent a grip enhancer opposite the attachment arm.
Figure 11:
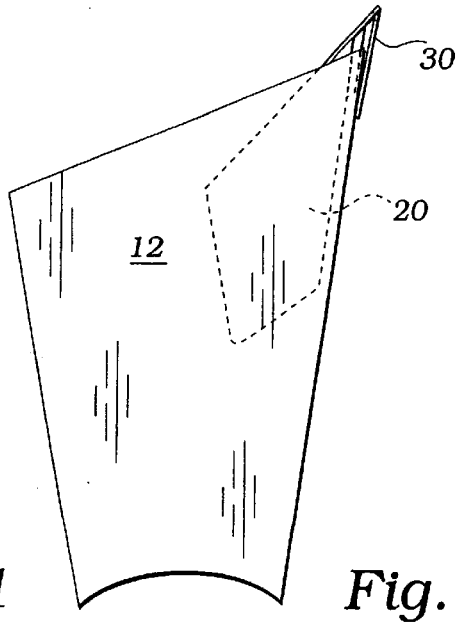
FIG. 11 is a side elevational view of an alternative embodiment in which the condiment cup is mounted inside the storage container.

In a second embodiment, as shown in FIG. 10, the condiment cup 10 includes a second attachment arm 60 and a single grip enhancer 50. The grip enhancer 50 is positioned between the attachment arm 30 and the second attachment arm 60. The grip surface 54 of the grip enhancer 50 is adapted to cooperate with the attachment arm 30 and the second attachment arm 60 to clamp the storage container sidewall 14 and thereby support the condiment cup 10 on the storage container sidewall 14.

Figure 12:
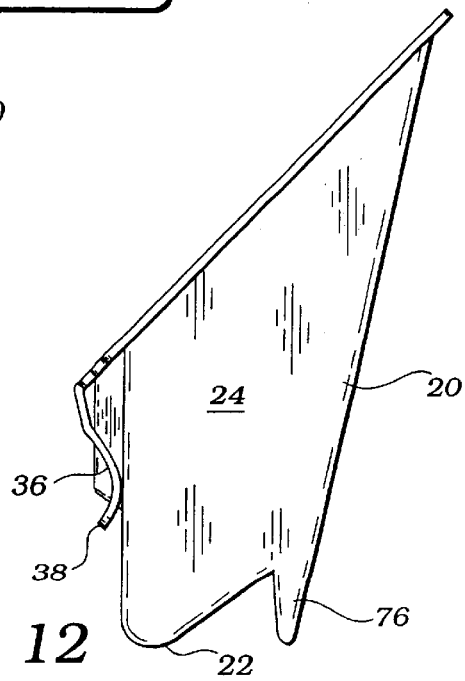
FIG. 12 is a side elevational view of an alternative embodiment in which the attachment arm includes a curved spring portion.

In an alternative embodiment, as shown in FIG. 12, the attachment arm 30 includes a curved spring portion 36 extending to the terminal end 38 that is outturned away from the upwardly extending sidewall 24. The attachment arm 30 is preferably constructed of a resilient material that enables the curved spring portion 36 to bend and accommodate the storage container sidewall 14 when the terminal end 38 captures the storage container sidewall 14, the curved spring portion 36 then functioning to bias the attachment arm 30 against the storage container sidewall 14, thereby further enhancing the grip of the attachment arm 30 against the storage container sidewall 14.

Figure 13:
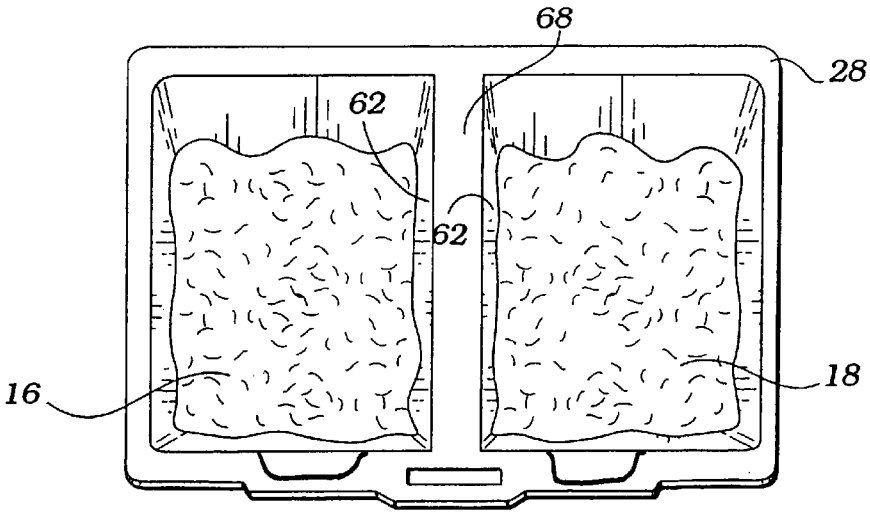
FIG. 13 is a top plan view of an alternative embodiment that includes a divider sidewall that separates the condiment container into first and second compartments.

In an alternative embodiment, as shown in FIG. 13, the condiment cup 10 further includes a divider sidewall 62 that is integral with the base 22 and the upwardly extending sidewall 24 and positioned to separate the storage space 26 into a first compartment 64 and a second compartment 66. The divider sidewall 62 includes a divider lip 68 that is adapted to be bonded to the sealing lid 40, thereby sealing the divider sidewall 62 and separating the first compartment 64 from the second compartment 66. This enables the storage of both the condiment 16 and a second condiment 18 within the condiment cup 10. For example, the condiment cup 10 could be used to store ketchup and barbeque sauce, cheese and salsa, chocolate and sprinkles, or any number of combinations of condiments.

Figure 14:
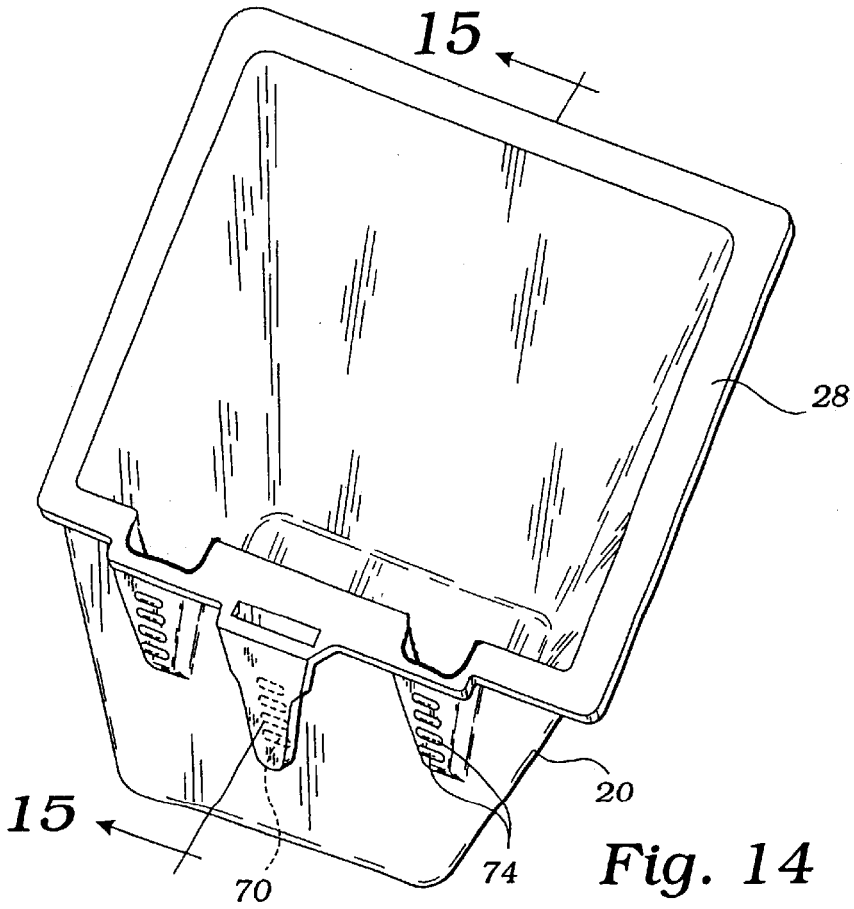
FIG. 14 is a perspective view illustrating a locking button of the attachment arm and a plurality of locking ribs of the grip enhancer.
Figure 15:
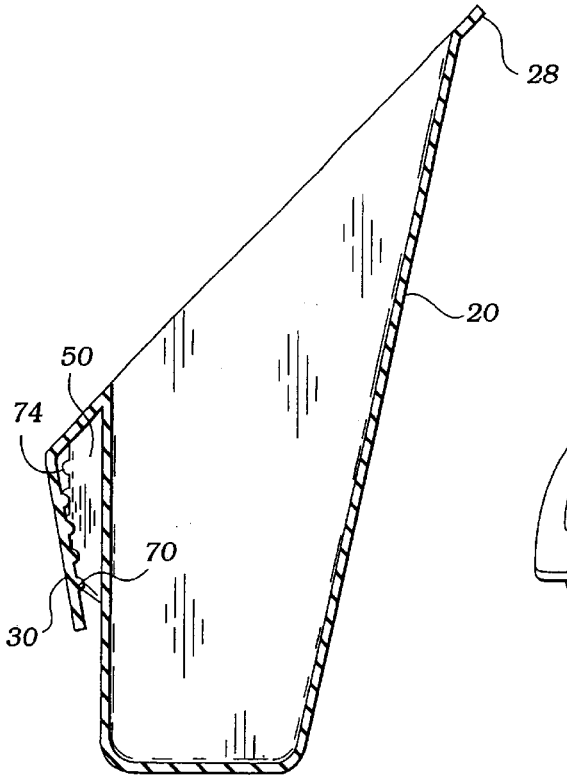
FIG. 15 is a sectional view thereof taken along line 15—15 in FIG. 14.

In an alternative embodiment, as shown in FIGS. 14 and 15, the condiment cup 10 further includes a locking button 70 or buttons extending from an inner surface of the attachment arm 30. The locking button 70 functions to increase the strength of the connection between the condiment cup 10 and the storage container sidewall 14. The connection can be especially strong if the storage container sidewall 14 includes a dimple that matches the locking button 70.

In an alternative embodiment, as shown in FIGS. 10, 14, and 15, the condiment cup 10 further includes a plurality of locking ribs 74 extending from the grip surface 54 of the at least one grip enhancer 50. The plurality of locking ribs 74 further function to increase the strength of the grip of the at least one grip enhancer 50 upon the storage container sidewall 14.

Figure 3:
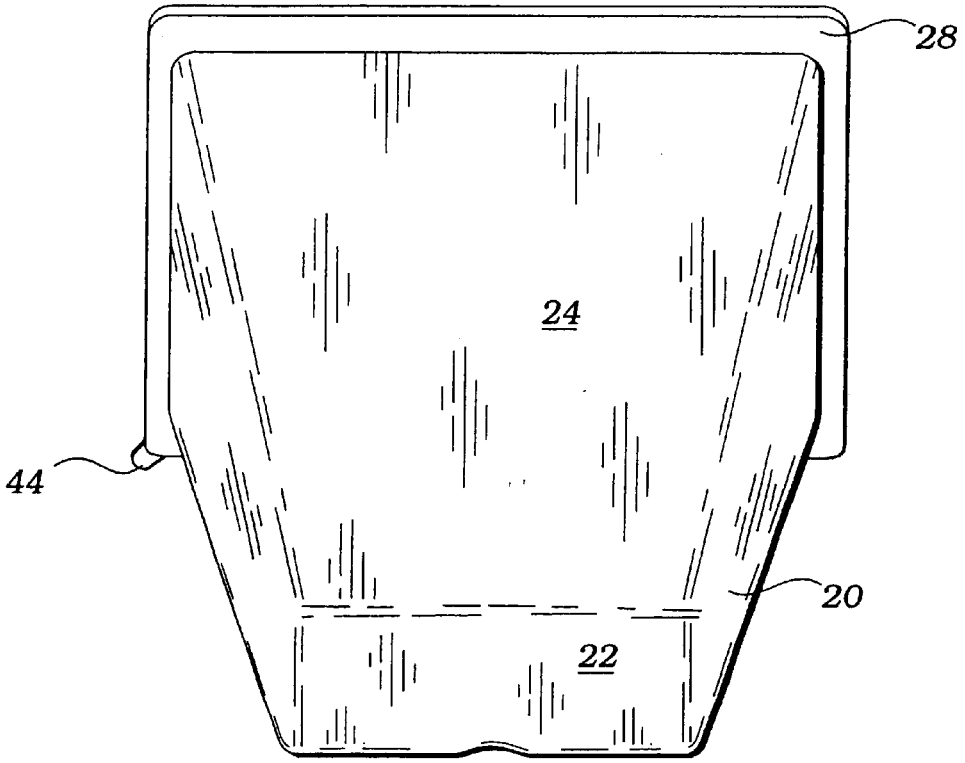
FIG. 3 is a rear side elevational view thereof.
Figure 4:
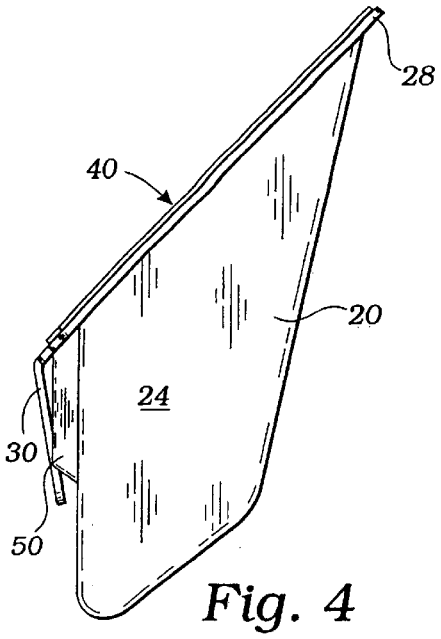
FIG. 4 is a side elevational view thereof.
Figure 5:
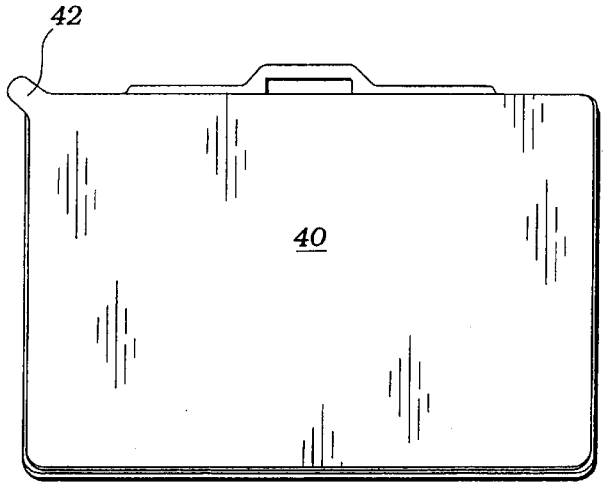
FIG. 5 is a top plan view thereof.
Figure 6:
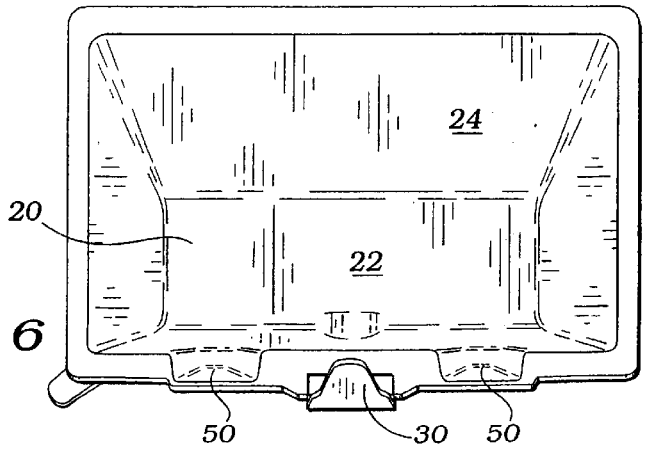
FIG. 6 is a bottom plan view thereof.

The condiment container 20 preferably has a base 22 that is angled, as shown in FIGS. 3 and 15, to facilitate dipping the food into the condiment 16. In one embodiment, as shown in FIG. 12, the condiment cup 10 further includes at least one support leg 76 extending downwardly from the base 22 of the condiment container 20. The at least one support leg 76 is adapted to cooperate with the base 22 to support the condiment container 20 in an upright orientation when the condiment container 20 is placed upon a surface.

In an alternative embodiment, as shown in FIG. 15, the base 22 is planar and adapted to support the condiment cup 10 on a surface such as a table, in addition to attaching the condiment cup 10 onto the storage container sidewall 14.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A condiment cup comprising:

a condiment container having a base and an upwardly extending sidewall that together define a storage space, the upwardly extending sidewall terminating in a perimeter lip that defines an opening for accessing the storage space;

an attachment arm extending downwardly from the perimeter lip to a terminal end; and a nesting aperture behind the attachment arm.

2. The condiment cup of claim 1 further comprising at least one grip enhancer extending outwardly from the upwardly extending sidewall adjacent the attachment arm, the at least one grip enhancer providing an outwardly extending sidewall that is integral with the upwardly extending sidewall and supports a grip surface, the grip surface being an elongate surface that is vertically aligned with and horizontally spaced from the attachment arm, a top edge of the grip surface being located further from the base than the terminal end of the attachment arm such that the grip surface is adapted to cooperate with the attachment arm to clamp the storage container sidewall and thereby support the condiment cup on the storage container sidewall.

3. The condiment cup of claim 2 wherein the perimeter lip includes a nesting recess shaped to receive the at least one grip enhancer.

4. The condiment cup of claim 2 wherein the at least one grip enhancer includes two grip enhancers, one of the two grip enhancers being horizontally spaced on either side of the attachment arm.

5. The condiment cup of claim 4 wherein the perimeter lip on either side of the attachment arm includes a nesting recess shaped to receive one of the two grip enhancers.

6. The condiment cup of claim 1 wherein the attachment arm includes an upper portion and a nesting portion, the upper portion having a width that is greater than the width of the nesting aperture, and the nesting portion having a width that is less than the width of the nesting aperture.

7. The condiment cup of claim 6 wherein the upper portion and the nesting portion are separated by a nesting shoulder.

8. A condiment cup comprising:

a condiment container having a base and an upwardly extending sidewall that together define a storage space, the upwardly extending sidewall terminating in a perimeter lip that defines an opening for accessing the storage space; and an attachment arm having an outwardly extending portion and a downwardly extending portion, the outwardly extending portion extending outwardly from the terminal lip, the outwardly extending portion having a nesting aperture, the downwardly extending portion extending downwardly from the outwardly extending portion, the downwardly extending portion having an upper portion and a nesting portion, the upper portion having a width that is greater than the width of the nesting aperture, and the nesting portion having a width that is less than the width of the nesting aperture.

9. The condiment cup of claim 8 further comprising at least one grip enhancer extending outwardly from the upwardly extending sidewall adjacent the attachment arm, the at least one grip enhancer providing an outwardly extending sidewall that is integral with the upwardly extending sidewall and supports a grip surface, the grip surface being an elongate surface that is vertically aligned with and horizontally spaced from the attachment arm, a top edge of the grip surface being located further from the base than the terminal end of the attachment arm such that the grip surface is adapted to cooperate with the attachment arm to clamp the storage container sidewall and thereby support the condiment cup on the storage container sidewall.

10. The condiment cup of claim 9 wherein the perimeter lip includes a nesting recess shaped to receive the at least one grip enhancer.

11. The condiment cup of claim 9 wherein the at least one grip enhancer includes two grip enhancers, one of the two grip enhancers being horizontally spaced on either side of the attachment arm.

12. The condiment cup of claim 11 wherein the perimeter lip on either side of the attachment arm includes a nesting recess shaped to receive one of the two grip enhancers.

13. The condiment cup of claim 8 wherein the attachment arm includes an upper portion and a nesting portion, the upper portion having a width that is greater than the width of the nesting aperture, and the nesting portion having a width that is less than the width of the nesting aperture.

14. The condiment cup of claim 8 wherein the upper portion and the nesting portion are separated by a nesting shoulder.

15. The condiment cup of claim 8 wherein the upwardly extending sidewall includes at least one shaped portion that is shaped to prevent the condiment container from over-nesting.

16. The condiment cup of claim 15 wherein the at least one shaped portion includes a plurality of generally curved sections.

17. The condiment cup of claim 16 wherein the plurality of generally curved sections each include a flat base portion.

* * * * *